US006589344B2

(12) United States Patent
Cho

(10) Patent No.: US 6,589,344 B2
(45) Date of Patent: Jul. 8, 2003

(54) GLASS SEALER SPRAY SYSTEM FOR VEHICLE

(75) Inventor: Kyu-Tag Cho, Kyungki-Do (KR)

(73) Assignee: Hyundai Motor Company, Seoul (KR)

( * ) Notice: Subject to any disclaimer, the term of this patent is extended or adjusted under 35 U.S.C. 154(b) by 9 days.

(21) Appl. No.: 09/752,618

(22) Filed: Dec. 28, 2000

(65) Prior Publication Data

US 2001/0011521 A1 Aug. 9, 2001

(30) Foreign Application Priority Data

Dec. 28, 1999 (KR) ..... 99-63654

(51) Int. Cl.[7] ..... B05B 3/18; B05C 5/02
(52) U.S. Cl. ..... 118/323; 118/706; 65/171
(58) Field of Search ..... 118/321, 323, 118/500, 679, 783, 305, 256, 706; 65/171, 152, 270, 271, 272, 370.1; 427/424; 239/722

(56) References Cited

U.S. PATENT DOCUMENTS 2,960,060 A * 11/1960 Chatterton ..... 118/679
4,458,628 A * 7/1984 Fujii et al. ..... 118/321
4,564,410 A * 1/1986 Clitheros ..... 156/356
4,809,885 A * 3/1989 Hayashi et al. ..... 118/305

* cited by examiner

*Primary Examiner*—Richard Crispino
*Assistant Examiner*—Yewebdar T Tadesse
(74) *Attorney, Agent, or Firm*—Christie, Parker & Hale, LLP

(57) ABSTRACT

A glass sealer spray system for a vehicle windshield, the system including: an air controller; a sealer spray frame with the air controller mounted at one side of the sealer spray frame; glass contact rollers each mounted at left and right sides of the sealer spray frame; a spray nozzle unit movably mounted on the midsection of the sealer spray frame between the glass contact rollers; a glass press roller unit rotated by power transmitted to it and mounted at one side of the spray nozzle; and a variable motor unit disposed underneath the sealer spray frame for transmitting power to the glass press roller unit.

9 Claims, 2 Drawing Sheets

GLASS SEALER SPRAY SYSTEM FOR VEHICLE

BACKGROUND OF THE INVENTION

CROSS-REFERENCE TO RELATED APPLICATION

This application claims priority of Korea patent Application No. 99-63654, filed on Dec. 28, 1999.

1. Field of the Invention

The present invention relates to a glass sealer spray system for a vehicle, and more particularly to a glass sealer spray system for a vehicle adapted to automatically spray sealer to a sealer spray area of a window shield glass.

2. Description of the Prior Art

FIG. 1 illustrates the prior art of using a sealer gun, where sealer 2 is sealed before assembly in order to prevent inflow of water after a window shield glass 4 is assembled.

In order to spray the sealer 2, a sealer can 6 is mounted to an air sealer gun 8 and a worker sprays the sealer 2 along the margin of the window shield glass 4 by way of air force. This type of sealer spray method typically has been practiced by a skilled worker.

However, there is a problem in the spray of sealer to the glass according to the prior art thus described in that sealer is excessively sprayed according to the degree of skill of a worker, generating an extreme waste of sealer. There is another problem in that spray of sealer is not uniform, resulting in a fear of dirting a surrounding area of the glass.

SUMMARY OF THE INVENTION

The present invention is disclosed to solve the aforementioned problems and it is an object of the present invention to provide a glass sealer spray system for a vehicle adapted to automatically spray sealer to a sealer spray region of a window shield glass.

In accordance with the objects of the present invention, there is provided a glass sealer spray system for a vehicle windshield, the system comprising: an air controller; a sealer spray frame with the air controller mounted at one side of the sealer spray frame; glass contact rollers each mounted at left and right sides of the sealer spray frame; a spray nozzle unit movably mounted on the midsection of the sealer spray frame between the glass contact rollers; a glass press roller unit rotated by power transmitted to it and mounted at one side of the spray nozzle; and a variable motor unit disposed underneath the sealer spray frame for transmitting power to the glass press roller unit.

When a glass is supplied to a sealer spray device, one side thereof is supported by the glass contact roller while the other side thereof is supported by the glass press roller. When the spray nozzle unit is moved to be positioned at a sprayed region of the glass and when air is supplied by the air controller, the air presses and spurts the sealer filled in the spray nozzle unit to finish the sealer spray work. Furthermore, in order to spray the sealer on a curvature of the glass, the glass should be rotated, such that the movable motor is activated to make the glass press roller rotated and to allow the curvature to be positioned at the spray nozzle unit, where the air controller is controlled to have the sealer sprayed, making the sealer spraying work simple and convenient.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

A preferred embodiment of the present invention will now be described in detail with reference to the accompanying drawings.

Figure 1:
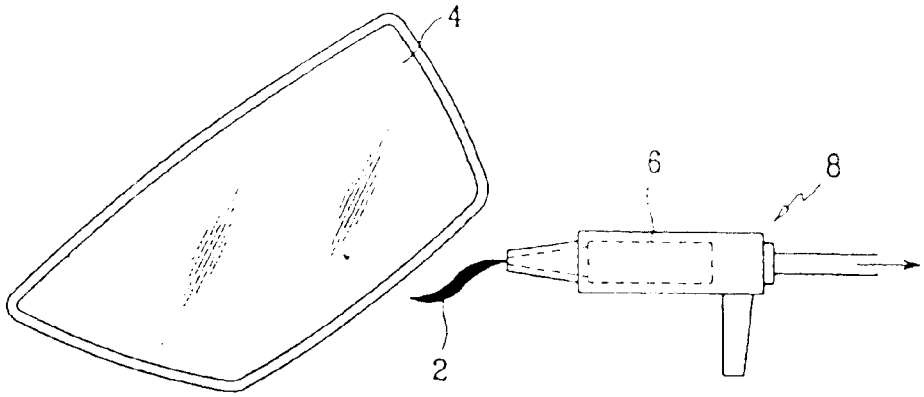
FIG. 1 (prior art)
FIG. 1 is a schematic drawing for illustrating a sealer gun used for spraying sealer according to the prior art.
Figure 2:
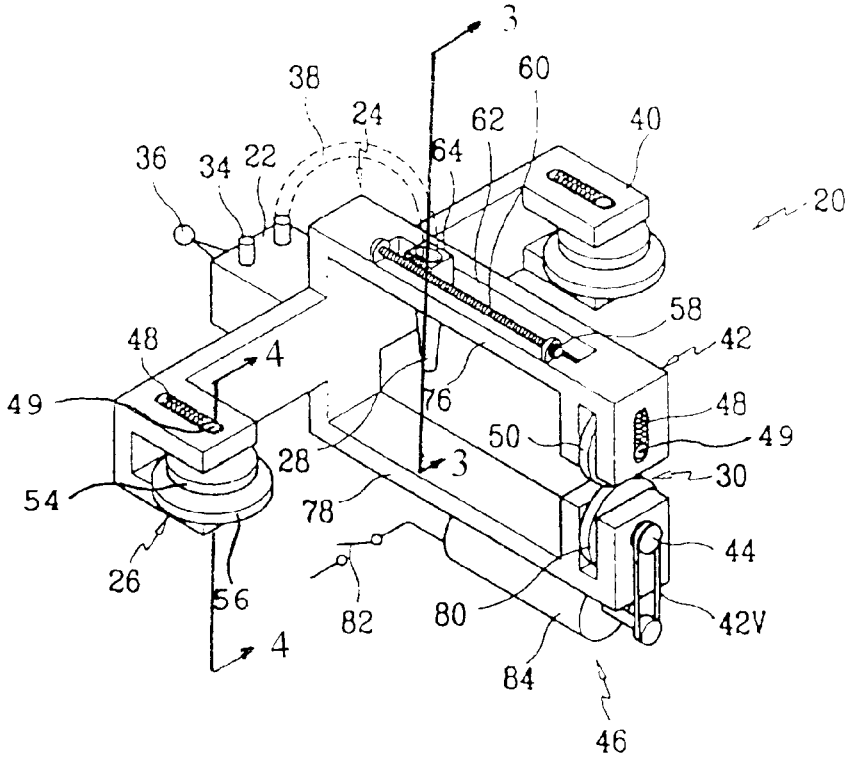
FIG. 2 is a schematic drawing for illustrating a glass spray system according to the present invention.
Figure 3:
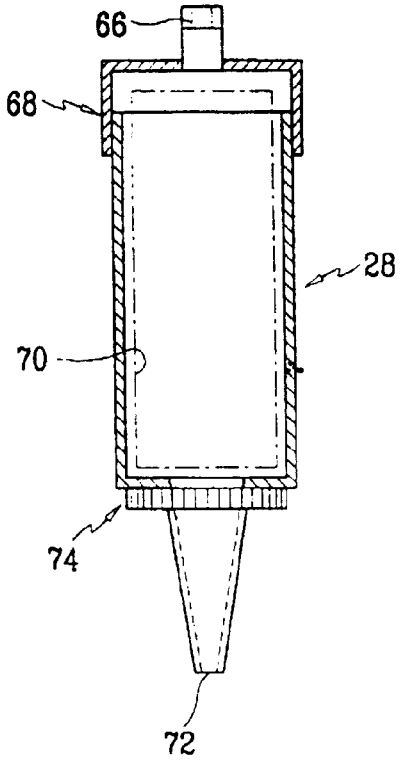
FIG. 3 is a sectional view taken along line 3—3 of FIG. 2.
Figure 4:
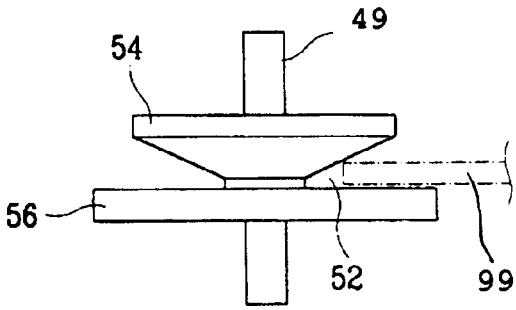
FIG. 4 is a sectional view taken along line 4—4 of FIG. 2.

FIG. 2 is a schematic drawing for illustrating a glass sealer spray system according to the present invention, FIG. 3 is a sectional view taken along line 3—3 of FIG. 2, and FIG. 4 is a sectional view taken along line 4—4 of FIG. 2.

A glass sealer spray system 20 is comprised of an air controller 22, a sealer spray frame 24, glass contact rollers 26, a spray nozzle unit 28, a glass press roller 30 and a variable motor unit 46.

The air controller 22 includes an air pump 34 for generating air, an air on/off valve 36 for controlling the drive of the air pump 34 and an air pipe 38 through which the air is supplied by connecting the air pump 34 and the spray nozzle unit 28.

The spray frame 24 is composed of extension holders 40 each mounted with the air controller 22 at one side thereof and extended to both sides at a predetermined length for the glass contact rollers 26 to be mounted thereon, and support holders 42 respectively and forwardly extended from central upper and lower areas of the extension holder 40 to allow upper and lower glass press rollers 30 and spray nozzle unit 28 to be mounted thereon. The support holder 42 is formed thereunder with the variable motor unit 46 in order to connect the glass press roller 30 to a pulley 44 via a belt 42V for rotation.

The glass contact rollers 26 are respectively disposed at both extension holders 40 of the sealer spray frame 24.

The glass contact rollers 26, each mounted at the extension holder 40 and supported by a rotary axle 49, are composed of a large wheel 56 for supporting the glass 99, a small wheel 54 mounted on the large wheel 56 and formed with a smaller diameter than that of the large wheel 56, and a guide groove 52 formed between the large wheel 56 and the small wheel 54.

The spray nozzle 28 is so mounted as to move lengthwise on the support holder 42 formed thereon. The spray nozzle 28 of a predetermined length includes a worm gear 60 mounted with an adjusting screw 58 at one side thereof and a nozzle unit 64 formed at a slide hole 62 for being movably meshed with the worm gear 60.

The nozzle unit 64 is disposed with a cap 68 forming a nipple 66 so as to be connected with an air pipe 38 and a nozzle cup 74 screwed to the cap 68 and mounted with a sealer can 70 formed with an injection nozzle 72 through which the sealer is ejected.

The glass press roller 30 is rotated by the variable motor unit 46 mounted at one side of the spray nozzle unit 28.

The glass press roller 30 includes a first press roller 50 mounted at a rotary axle 49 resiliently supported to a resilient member 48 at an upper support holder 76 and inwardly formed therein with a tapered surface and a second press roller 80 oppositely arranged from the first press roller 50 at a rotary axle mounted with a pulley 44 at a lower support holder 78 and inwardly formed therein with a tapered surface.

The variable motor unit 46 is disposed underneath the sealer spray frame 24 and activated by a manipulating switch 82 for supplying power to the glass press roller 30. The variable motor unit 46 also includes the belt 42V for connecting another pulley 44 mounted at a rotary axle of the variable motor 84 to the pulley 44 formed at a rotary axle of the second press roller 80.

Now, operation and effect thereof will be described.

When the glass is supplied to the sealer spray system 20, the glass is supported at one side thereof by the glass contact roller 26 while it is supported at the other side thereof by the glass press roller 30.

When spraying is prepared, the spray nozzle 28 is moved to be positioned at a domain to be sprayed at the glass, and when the air on/off valve 36 of the air controller 22 is manipulated to make the air supplied to the spray nozzle 28 through the air pipe 38, the air presses the sealer can 70 formed at the spray nozzle 28 to force the sealer to be pressingly ejected to the injection nozzle 72 for sealer spraying work.

Furthermore, the glass should be rotated to spray sealer to the curvature thereof, where, when the manipulating switch 82 is turned on, the variable motor 84 is activated to rotate the glass press roller 30 and to cause the curvature of the glass to come near a position where ejection by the spray nozzle 28 can work thereon, and the air on/off valve 36 of the air controller 22 is controlled to allow the spray nozzle 28 to spray the sealer, making the whole sealer spraying work simple and convenient.

As apparent from the foregoing, there is an advantage in the glass sealer spray system for vehicle thus described in that a predetermined quantity of sealer is automatically sprayed to a glass spray region without any waste.

There is another advantage in that the predetermined quantity of sealer is accurately sprayed by a spray nozzle to make the spraying work simple, swift and clean, thus improving the finishing touch of spraying of the sealer.

What is claimed is:

1. A glass sealer spray system for a vehicle windshield the system comprising:

an air controller;

a sealer spray frame with the air controller mounted at one side of the sealer spray frame;

glass contact rollers each mounted at left and right sides of the sealer spray frame;

a spray nozzle unit movably mounted on the midsection of the sealer spray frame between the glass contact rollers;

a glass press roller unit rotated by power transmitted to it and mounted at one side of the spray nozzle; and a variable motor unit disposed underneath the sealer spray frame for transmitting power to the glass press roller unit.

2. The system as defined in claim 1, wherein the air controller comprises:

an air pump for generating air;

an air on/off valve for controlling the drive of the air pump; and an air pipe through which the air is supplied by connecting the air pump and the spray nozzle unit.

3. The system as defined in claim 1, wherein the spray frame comprises:

extension holders, each mounted with the air controller at one side of the spray frame and extended to both sides of the spray frame at a predetermined length for the glass contact rollers to be mounted thereon; and support holders respectively and forwardly extended from central upper and lower areas of the extension holder to allow upper and lower glass press rollers and the spray nozzle unit to be mounted thereon.

4. The system as defined in claim 3, wherein a variable motor is mounted underneath the support holders in order to connect the glass press roller to a pulley via a belt for rotation.

5. The system as defined in claim 1, wherein the glass press roller comprises:

a large wheel for supporting the vehicle windshield glass;

a small wheel mounted on the large wheel and formed with a smaller diameter than that of the large wheel; and a guide groove formed between the large wheel and the small wheel for guiding the vehicle windshield.

6. The system as defined in claim 1, wherein the spray nozzle comprises:

a worm gear mounted with an adjusting screw at one side thereof;

a nozzle unit formed at a slide hole for being movably meshed with the worm gear.

7. The system as defined in claim 1, wherein the nozzle unit comprises:

a cap forming a nipple so as to be connected with an air pipe; and a nozzle cup screwed to the cap and mounted with a sealer can formed with an injection nozzle through which the sealer is ejected.

8. The system as defined in claim 1, wherein the glass press roller comprises:

a first press roller mounted on a rotary axle resiliently supported to a resilient member at an upper support holder and inwardly formed therein with a tapered surface; and a second press roller oppositely arranged from the first press roller mounted on a rotary axle with a pulley at a lower support holder and inwardly formed therein with a tapered surface.

9. The system as defined in claim 1, wherein the variable motor disposed underneath the sealer spray frame for supplying power to the glass press roller includes a belt for connecting a pulley mounted on a rotary axle of the variable motor to another pulley formed at a rotary axle of the second press roller.

* * * * *